United States Patent [19]

Tuggle

[11] 4,400,926

[45] Aug. 30, 1983

[54] INTEGRATED DIMORPHIC STRUCTURE

[76] Inventor: Gordon P. Tuggle, P.O. Box 6522, Portsmouth, Va. 23703

[21] Appl. No.: 294,972

[22] Filed: Aug. 21, 1981

[51] Int. Cl.[3] ..... E04H 12/18

[52] U.S. Cl. ..... 52/646

[58] Field of Search ..... 52/645, 646, DIG. 10, 52/80, 81, 637, 641

[56] References Cited

U.S. PATENT DOCUMENTS

| | | | |
|---|---|---|---|
| 3,175,650 | 3/1965 | Hartford et al. | 52/646 |
| 3,185,164 | 5/1965 | Piñero | 52/646 X |
| 3,277,479 | 10/1966 | Struble | 52/DIG. 10 |
| 3,348,352 | 10/1967 | Cummings | 52/646 |
| 3,771,274 | 11/1973 | Vaughan | 52/646 |
| 3,830,031 | 8/1974 | Soisson | 52/645 |
| 4,337,560 | 7/1982 | Slysh | 52/646 X |

*Primary Examiner*—J. Karl Bell

*Attorney, Agent, or Firm*—Wm. Jay Monahan

[57] ABSTRACT

An integrated dimorphic rod and joint truss structure which is erected simply and quickly from a collapsed to a high strength, rigid or semi-rigid three-dimensional form using interconnected square base members and quadrilaterals which are erected from a collapsed position on the base members to an upright and then to a skewed or twisted position creating adjacent right square pyramids having vertices joined in squares. The right square pyramid shapes produced have a high load-bearing capacity and may be arranged to produce flat, arched, vaulted or compound three-dimensional structures useful in comprising and supporting roofs, floors or portions of other structures.

18 Claims, 20 Drawing Figures

INTEGRATED DIMORPHIC STRUCTURE

BACKGROUND OF THE INVENTION

The construction industry is making increased use of prefabricated trusses in constructing a variety of buildings. Steel buildings have been developed using aircraft structures techniques which may be quickly erected while producing high strength for low weight. Large portions of these steel buildings are fabricated for quick erection, but there is little or no use of prefabricated collapsible steel trusses for these building, or in fact, little use of such trusses in buildings.

The major drawbacks to the use of such trusses appears to be size when the trusses are not fully collapsible, difficulty in erection when rigidity is lacking and the ratio of strength to weight of the erected truss. If, however, these problems could be solved, one serious dilemma in the erection of steel and other prefabricated structures would be alleviated.

As many erections have painfully learned, high winds during building erection can play havoc with aircraft-type structures which use their metal structural covering for much of their strength. Prefabricated truss members could be preassembled in an essentially flat shape at ground level before being erected in support of a wall or roof. Exposure to potentially disastrous winds would be minimized and greater strength to weight provided without significant increase in erection time.

In addition to resolution of this construction industry problem, the light weight compactness of the easily-assembled subject structure lends itself to space applications for such things as manned stations assembled in orbit. The expanding field of oceanography will soon require such structures in marine applications. In the area of portable structures for the military or for campers, the subject invention can provide a shelter from a variety of harsh environments and may be easily erected despite such environmental conditions.

Accordingly, it is an object of the invention to provide a truss structure which may be collapsed to as compact a form as possible for shipment to an erection site.

It is a further object of the invention to provide a truss structure which may be easily and quickly erected from its collapsed form to its truss form.

It is an object of the invention to provide a collapsible truss member which when assembled provides rigidity and high strength for low weight.

It is also an object of the invention to provide a rod and joint truss structure wherein said joints are simple and inexpensively produced.

It is a further object of the invention to produce a collapsible truss which may be erected to form arched, vaulted or compound structural members.

It is a further object of the invention to provide a collapsible truss member to be assembled and erected as a part of a larger structure and which will provide rigidity after its erection while other parts of the larger structure are installed.

SUMMARY OF THE INVENTION

An integrated, dimorphic, rod and joint truss structure comprising square base members and collapsible quadrilateral shapes sharing a common side with each base member and collapsing upon said base member for delivery and storage. When at least four base members are laid flat and joined to form a larger square, the four collapsed quadrilateral shapes connected to the central bisecting lines of the larger square are first erected to the vertical and then twisted 90° in a common direction when viewed from the top (all clockwise or all counter-clockwise) so that the top member of each quadrilateral may be connected to form a square.

When many squares base members are interconnected and their attached quadrilateral members assembled as described, a truss of interconnected right square pyramids is formed having the base members as their base and connected at their vertices in squares by top members. These top squares may also be viewed as bases for inverted right square pyramids. The edges of two adjacent right square pyramids, whether viewed as upright or inverted, the common base member between them and the top members connecting their vertices form a tetrahedron. One may also describe this truss as an assemblage of intermeshed tetrahedrons and right square pyramids.

In the preferred embodiment, the top member of the quadrilateral members is the same length as the sides of the base member and the square formed by connecting the vertices of adjacent right square pyramids is identical in size to the square base members. To produce an arched truss, the vertices of adjacent right square pyramids are connected in rectangles by top members having a long dimension equal in length to the sides of the base squares and a short dimension shorter than the sides of the base square. Since these quadrilaterals are smaller than the square base members, they collapse easily upon them for storage. When erected, however, the completed arch must be inverted since the smaller "top" members form the concave surface of the arch.

Vaulting is produced when the vertices of the right square pyramids are connected by squares or rectangles whose dimensions are all shorter than those of the base squares. Arched and vaulted structures must be inverted after assembly for optimum load bearing.

The base squares may be jointed to allow further compaction by scissoring. The quadrilaterals are jointed at all four corners to permit the twisting previously described and include connectors at their upper ends when vertically erect to permit rigid fastening at the vertex of each right square pyramid. These joints may be of a variety of cheaply constructed, quickly assembled types. Rods and joints may be made from a variety of materials as the assembled truss is quite strong.

BRIEF DESCRIPTION OF THE DRAWINGS

FIG. 8E is a perspective view of a joint connecting quadrilateral side members to top members while

FIGS. 8A–G are all related to joints and connectors which may be used with the preferred embodiment.

DESCRIPTION OF THE PREFERRED EMBODIMENT

Figure 1:
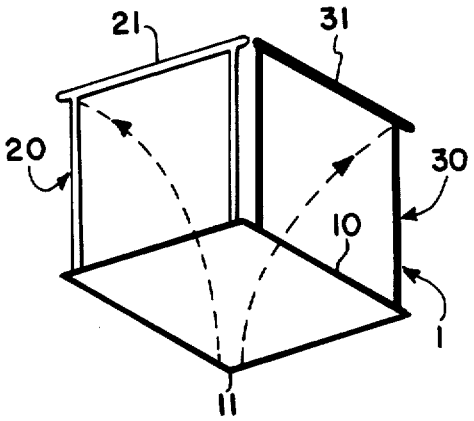
FIG. 1 is a schematic perspective view of the basic unit of the novel truss showing initial upright erection from a collapsed position.

Referring now to the drawings, FIG. 1 shows a basic unit of the novel truss when quadrilaterals 20 and 30, which resemble goalposts, have been erected (see dotted lines) to an upright position from a collapsed position resting on square base members 10. The two top members 21 and 31 of quadrilaterals 20 and 30 are the same length as the base members 10. As a point of reference for later figures a corner 11 of base members 10 has been identified.

Figure 2:
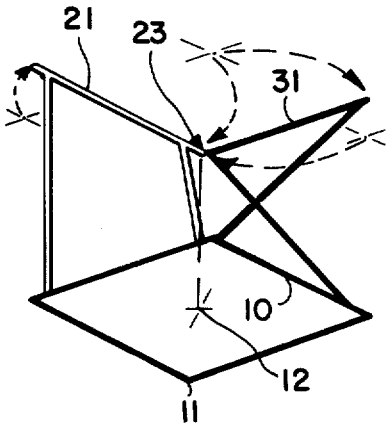
FIG. 2 is a schematic perspective view of the basic unit showing the next step in its assembly.
Figure 3:
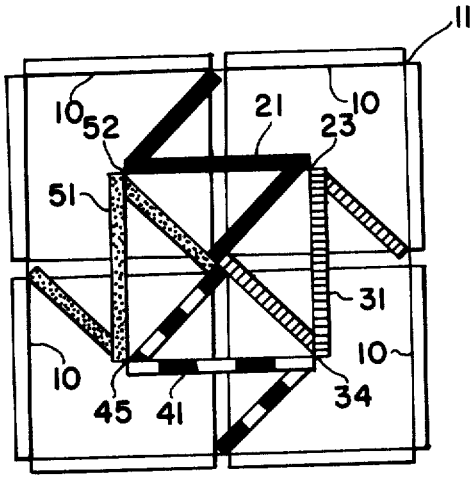
FIG. 3 is a schematic plan view of four basic units assembled to form a top square member.

In FIG. 2, the top members 21 and 31 have been twisted or skewed 90° in a clockwise direction as viewed from the top and joined at point 23 located vertically above the geometric center 12 of square base members 10. FIG. 3 shows the result when four sets of base members 10 are connected in a larger square and the top members 21, 31, 41 and 51 of quadrilaterals connected to the four sets of base members 10 near the geometric center and near the midpoints of the larger square are twisted counter-clockwise to form a top square having corners 23, 34, 45 and 32. Corner 11 of the upper right base square is retained to reference the first two figures.

Figure 4:
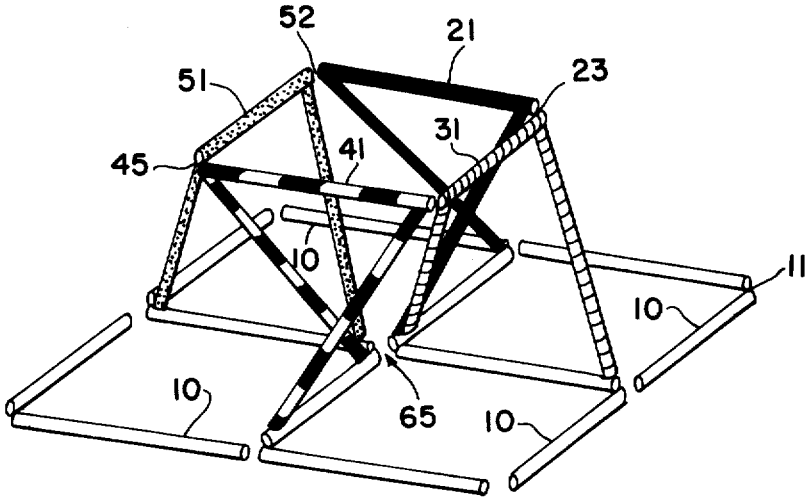
FIG. 4 is a schematic perspective view of the assembled units shown in FIG. 3.
Figure 5:
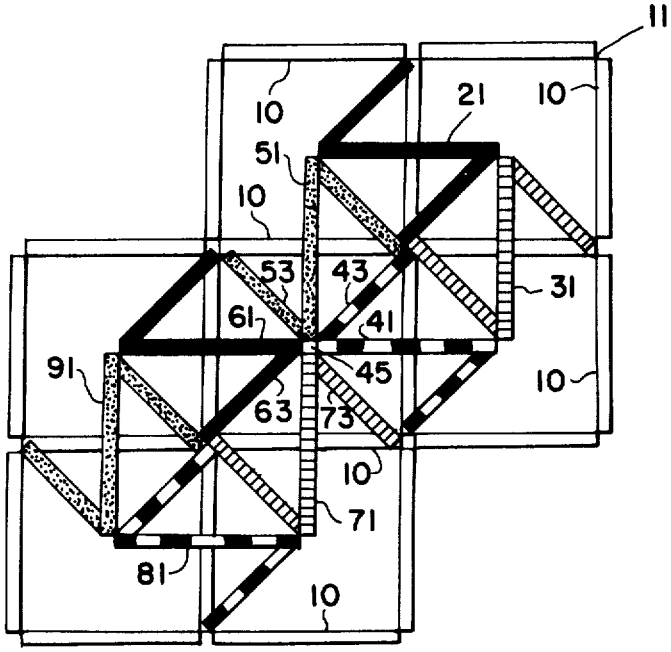
FIG. 5 is a schematic plan view of seven basic units assembled to produce two top square members and a right square pyramid under their common corner and resting on the central base member. Two inverted right square pyramids are formed under the two top squares.

FIG. 4 is a perspective view of the assembly shown in FIG. 3. The top square formed by members 21, 31, 41 and 51 serves as the base of an inverted right square pyramid having a vertex 65. FIG. 5 adds three more base member squares and four more quadrilaterals having top members 61, 71, 81 and 91. The top square formed by these four top members and the top square formed from 21, 31, 41 and 51 meet at the apex 45 of a right square pyramid comprised of side members 43, 53, 63 and 73 connected to their respective top members as shown by shading. This right square pyramid rests on the center-most base square. Note that the pyramid resting on the basic unit of 10, 21 and 31, referenced to FIG. 1 by corner 11, is incomplete, needing two more side members. The two top squares form the bases of two inverted pyramids as described above.

Figure 6A:
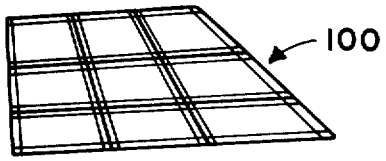
FIGS. 6A, 6B and 6C are schematic perspective views of a folded truss, a vertically erected truss, and the assembled truss respectively.
Figure 6B:
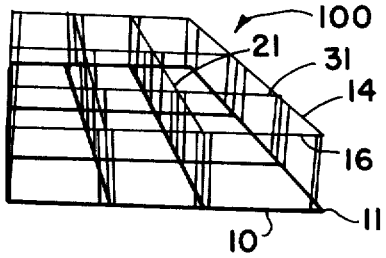
Figure 6C:
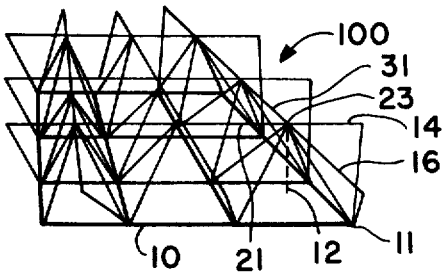

FIGS. 6A, 6B and 6C show the erection of a truss 100 comprised of nine base members from the collapsed position of FIG. 6A to the upright erected position of FIG. 6B to the twisted, assembled position of FIG. 6C. The truss of FIG. 6 contains 24 quadrilaterals because of the sides shared by adjacent base members. Square base members on two adjacent perimeter sides have 3 quadrilaterals rather than the 2 shown in FIGS. 1–5. Top members 14 and 16 coupled with 21 and 31 are rotated clockwise when viewed from the top and connected at point 23 producing the porcupine effect shown in FIG. 6C. Only the one side member of each quadrilateral including 14 and 16 which is connected at 23, the vertex point, is required.

Figure 7:
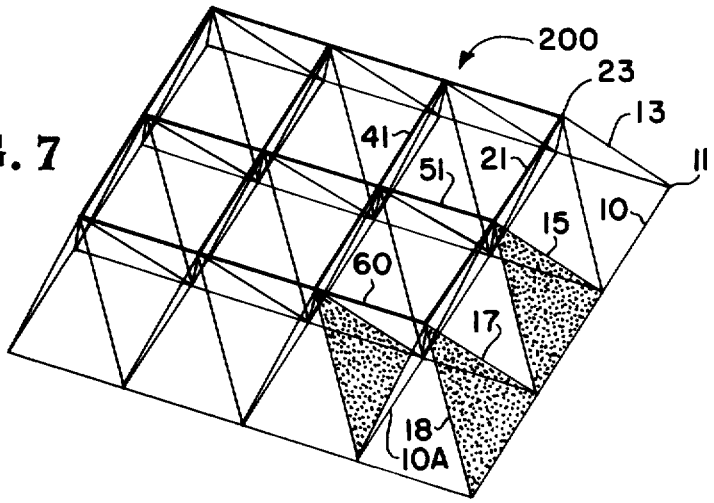
FIG. 7 is a schematic perspective view of the truss showing the component right square pyramids connected at their vertices by the top squares.

FIG. 7 shows how these excess members may be dispensed with to provide the compact truncated pyramid truss 200. Rather than adding quadrilaterals, only extra side members such as 13 and 18 have been added. One must be added at each perimeter corner of each square base unit to complete the pyramids resting on each corner square base unit.

Two upright pyramids, partially shaded in FIG. 7 share a common base member denoted 10A. The vertices of these two pyramids are connected by top member 60. The edges of these two pyramids connected to 10A and 60 form a tetrahedron which may be better visualized as follows. Considering the two pyramids and the adjacent inverted pyramid whose base member includes 51 and 60, the tetrahedron formed has all six of its edges and three of its surfaces in common with these three pyramids.

Figure 8A:
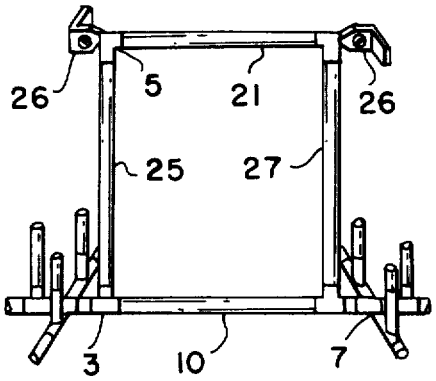
FIGS. 8A and 8B are perspective views of a connector used in assembly of the novel truss.
Figure 8B:
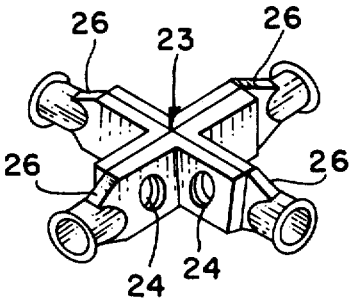

FIGS. 8A and 8B show typical connectors used to connect top members to form top squares. Note that while the sides of square bases 10 and the top members such as 21 of the quadrilaterals are of the same length, side members 25 and 27 are flexibly attached inboard of the ends of the top members and sides of the base square. Thus the pyramids formed will be slightly truncated, but the top squares will be the same size as the square base members. Bolts (not shown) through holes 24 connect the top members about point 23. Joints 3, 5 and 7 are shown schematically in FIG. 8A and in detail in FIGS. 8C–G.

Figure 8C:
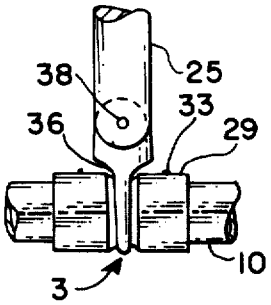
FIG. 8C is a plan view of a joint connecting base members to the side members of the quadrilaterals.
Figure 8D:
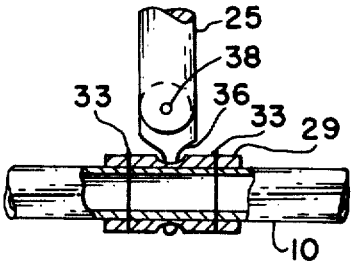
FIG. 8D is a cutaway view of this joint.

In FIGS. 8C and 8D, joint 3 connects quadrilateral side members, such as 25 and 27 shown in FIG. 8A, to base members 10. Joint 3 includes an eyelet connector 36 fitting around the groove in a grooved sleeve 29 which fits slidably over base members 10 and may be fixed in place by pins 33. Eyelet connector 36 is pivotally connected to a side member such as 25 (shown) by pivot pin 38, giving side member 25 two degrees of freedom to allow erection.

Figure 8E:
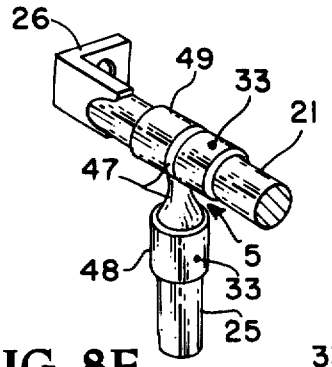
Figure 8F:
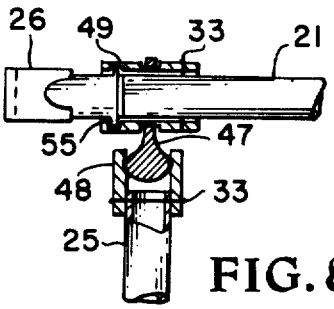
FIG. 8F is a cutaway view of this joint.

In FIGS. 8E and 8F, joint 5 connects quadrilateral side members, such as 25 and 27 shown in FIG. 8A, to top members such as 21 and to connectors 26. Eyelet ball joint connector 47 fits around an external groove in a grooved sleeve 49. One end of sleeve 49 fits over an end of top member 21 and is held in place by pin 33. The other end of sleeve 49 includes an internal groove containing a flange on the end of connector 26. This flange and internal groove is labelled 55 in FIG. 8F. The ball joint of connector 47 fits within socket sleeve 48 connected to side member 25 (or 27, not shown) by pin 33. Joint 5 allows three degrees of freedom for erection and allows rotation of connector 26 for alignment of connection 23.

Figure 8G:
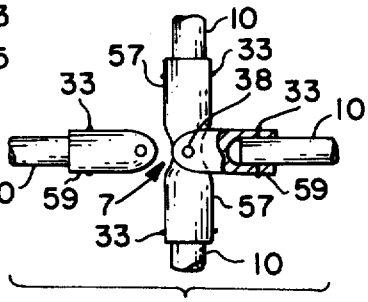
FIG. 8G is a cutaway plan view of a joint connecting base members.

Joint 7 is shown in FIG. 8G and consists of a necked-down sleeve member 57 pinned by pins 33 to ends of base members 10 and pivotally connected by pivot pin 38 to two clevis collar members 59, also pinned by pins 33 to the ends of base members 10. Joint 7 allows base members 10 to be scissored for shipment or storage.

Figure 9A:
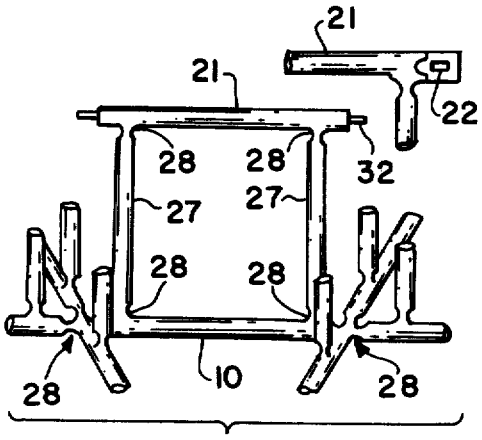
FIGS. 9A and 9B are perspective views of another type of connector which may be used with fatique-resistant materials such as molded nylon.
Figure 9B:
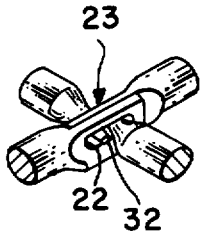

FIGS. 9A and 9B show alternative means of connecting the various truss members. Necked-down areas 28 are provided to allow the flexibility needed to collapse and to erect the truss structure. Slots 22 and spikes 32 are force fit for connection of the quadrilateral top members such as 21 shown in FIG. 9A.

Figure 10:
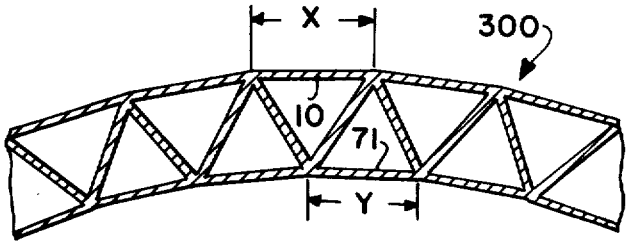
FIG. 10 is an elevational schematic view of a truss assembled to form an arched shape.

FIG. 10 shows an arched truss 300 produced by making the top squares, formed when the truss is erected, into rectangles having a long dimension equal in length to the base member 10, erected perpendicular to the plane of the arch and therefore not shown in FIG. 10, which is a schematic section parallel to the plane of the arch, and a short dimension Y which is shorter than the length X of base member 10 and erected parallel to the plane of the arch. The top members, such as 71 shown in FIG. 10 as an example, being shorter than the base members 10 permit easy folding for storage, but if they are erected as top members, the truss must be inverted to produce the arch as shown.

Figure 11:
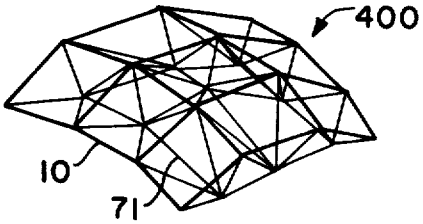
FIG. 11 is a schematic perspective view of a truss assembled to form a vaulted shape.

If all the "top" members are shorter than the base square members, the resultant structure when erected and inverted produces the vaulted truss 400 shown in FIG. 11. Again the base members 10 must be longer than the "top" members (71 is shown as descriptive) to allow collapsing of the structure for storage or shipment, and the assembled structure must be inverted so that the larger "base" squares are above the smaller "top" squares.

OPERATION

Operation of the trusses, in terms of their assembly and disassembly as described above, is now believed to be apparent. Assembly steps are shown best in FIGS. 6A–C for a completed planar truss. First the quadrilaterals are raised to an upright position and then the top member of each quadrilateral is rotated ninety degrees in a uniform direction—counter-clockwise or clockwise to a skewed and twisted position, as shown in FIGS. 5 and 6C—and the top members are connected as shown in FIGS. 8B and 9B, depending upon the type of structural member used, to form pyramids joined at their apex to form top surfaces.

For a planar base truss, the base squares and top squares are of the same dimensions. For arched trusses, the top members are of two lengths. All top members parallel to the plane of the arch when erected are shorter than the base members and all other top members are of equal length to the base members. The resultant erected truss must be inverted to produce the arch.

Vaulted trusses are produced when all top members are shorter than base members and top squares are smaller than base squares. Again, the erected truss is inverted to produce the vaulted effect.

When collapsed as shown in FIG. 6A the truss may be scissored together for width compaction at the expense of elongation because the action of joints 7, 5 and 3 permit the base squares and quadrilaterals to be scissored from collapsed squares to collapsed diamonds. This feature permits transportation of wider trusses by conventional road and rail carriers, but joint 7 can be eliminated in smaller trusses.

Likewise, this disclosure principally teaches the basic structure and its method of erection. The joints and connectors and types of structural elements shown are merely illustrative. Many materials could be used in a variety of cross-sectional shapes. In referencing the relative sizes of base members and elements of the quadrilaterals, there is a necessity only for side members equal to or shorter than base members if fairly complete, collapsability is desired. Top squares and base squares must be equally sized only in a flat or planar-based truss. Flexible or semi-rigid, rather than rapid base and top members may be used in vaulted and arched trusses to allow these trusses to bend in the shape of the assembled arch or vaulted truss.

Obviously, numerous modifications and variations of the present invention are possible in the light of the above teachings. It is, therefore, to be understood that within the scope of the appended claims, the invention may be practiced otherwise than as specifically described therein.

What is claimed as new and desired to be secured by Letters Patent of the United States is:

1. An integrated dimorphic structure comprising:

base members connected to form a plurality of base squares attached together to form the base of a truss;

a plurality of quadrilateral members, each having a top member, two side members and one side in common with said base members and being flexibly attached to said base members.

connecting means for connecting said top members after said quadrilaterals are raised upright and each of said top members has been rotated in a common direction and approximately 90° relative to said one side of said quadrilateral containing said top member, whereby said top members are joined to form top squares and said side members form the edges of pyramids resting on said base squares.

2. The structure of claim 1 including scissor means for connecting said base squares and for allowing said connected base squares to be folded into diamond shapes of approximately parallel orientation when said top members are not connected by said connecting means.

3. The structure of claim 1 including two-dimensionally flexible means attached to said side members for connecting said side members to said base members, for allowing collapsing of said quadrilaterals upon said base squares for storage and transport and for allowing said approximately 90° rotation of said top members, and three-dimensionally flexible means connected to said side members, said three-dimensionally flexible means being for connecting said side members to said top members, for allowing collapsing of said quadrilateral upon said base squares for storage and transport and for allowing approximately 90° rotation of said top members.

4. The structure of claim 3 wherein said connecting means are rotatably attached to each of said top members for proper alignment in connecting said top members.

5. The structure of claim 4 including scissor means for connecting said base squares and for allowing said connected base squares to be folded into diamond shapes of approximately parallel orientation when said quadrilaterals are collapsed upon said base squares.

6. The structure of claim 1 wherein those of said top members oriented parallel to the plane of arching when connected have a length less than the length of said base members and the remainder of said top members have a length approximately the same as that of said base members, whereby said top members are connected to form top rectangles and the connected truss is inverted to form an arch.

7. The structure of claim 5 where those of said top members oriented parallel to a plane of arching when connected have a length less than the length of said base members and the remainder of said top members have a length approximately the same as that of said base members, whereby said top members are connected to form top rectangles and the connected truss is inverted to form an arch.

8. The structure of claim 1 wherein said top members have a length less than the length of said base members, whereby the connected truss is inverted to form a vaulting truss.

9. The structure of claim 5 wherein said top members have a length less than the length of said base members, whereby the connected truss is inverted to form a vaulting truss.

10. The structure of claim 6 wherein said top members and said base members are constructed with enough flexibility to bend in the shape of an arch formed when said top members are connected and said connected truss is inverted.

11. The structure of claim 8 wherein said top members and said base members are constructed with enough flexibility to bend in the shape of a vaulted truss formed when said top members are connected and said connected truss is inverted.

12. An integrated dimorphic structure comprising a truss of at least one pyramid having a vertex and a square base formed from base members, said pyramid being constructed from quadrilateral members attached to said base members, said quadrilateral members being flexible to permit vertical erection from a collapsed position on said base members to an upright position and then a twisted and skewed position and connecting means for connecting said quadrilateral members in said twisted and skewed position to form said pyramids and to connect the vertices of said pyramids.

13. A method of erecting a collapsible truss comprising the steps of:

providing a base consisting of base members forming a plurality of interconnected base squares;

providing quadrilateral members having a top member, two side members and one side in common with said base members, said quadrilateral members being flexibly connected to said base members and collapsed upon said base squares;

erecting said quadrilateral members to an upright position;

rotating said top members approximately 90° in a common direction; and connecting said top members together, whereby said top members form top squares and said side members form the sides of pyramids resting on said base squares.

14. The method of claim 13 wherein the step of providing a base includes the further steps of:

providing scissor means for interconnecting said base squares; and folding said base squares and said collapsed quadrilateral members to form said base squares into diamond shapes of approximately parallel orientation.

15. The method of claim 13 wherein the step of providing quadrilaterals includes providing top members of different lengths, those of said top members to be assembled in a plane of arching of said truss being shorter in length than said base members and the remaining numbers of said top members being approximately equal in length to said base members and including a final step of inverting the assembled truss to form an arched truss.

16. The method of claim 13 wherein the step of providing quadrilaterals includes providing top members shorter in length than said base members and including a final step of inverting the assembled truss to form a vaulted truss.

17. The method of claim 15 wherein the step of providing a base includes providing base members having enough flexibility to bend in the shape of an arch formed by the step of connecting, and the step of providing quadrilaterals includes providing top members having enough flexibility to bend in said shape.

18. The method of claim 16 wherein the step of providing a base includes providing base members having enough flexibility to bend in the shape of a vaulted truss formed by the steps of connecting and the step of providing quadrilaterals includes providing top members having enough flexibility to bend in said shape.

* * * * *